US007578237B2

(12) United States Patent
Johnston et al.

(10) Patent No.: US 7,578,237 B2
(45) Date of Patent: Aug. 25, 2009

(54) METHOD FOR CONTROLLING INITIATION OF A DETONATOR

(75) Inventors: Peter Johnston, Onehunga (AU); John Keir Russel, Onehunga (AU)

(73) Assignee: Redbull Powder Co. Limited, Auckland (NZ)

( * ) Notice: Subject to any disclaimer, the term of this patent is extended or adjusted under 35 U.S.C. 154(b) by 0 days.

(21) Appl. No.: 11/869,703

(22) Filed: Oct. 9, 2007

(65) Prior Publication Data

US 2008/0173201 A1 Jul. 24, 2008

Related U.S. Application Data

(62) Division of application No. 10/984,838, filed on Nov. 10, 2004, now abandoned.

(30) Foreign Application Priority Data

Nov. 12, 2003 (AU) ..... 2003906228

(51) Int. Cl.
*F42B 3/10* (2006.01)
*F42C 11/00* (2006.01)
*F23Q 21/00* (2006.01)

(52) U.S. Cl. ..... 102/217; 102/311; 102/301; 102/200; 102/202.5; 299/13

(58) Field of Classification Search ..... 102/301, 102/302, 311, 312, 313, 200, 206, 214, 215, 102/217, 202.5; 166/63, 299; 175/4.55–4.59; 299/13
See application file for complete search history.

(56) References Cited

U.S. PATENT DOCUMENTS

| | | | | |
|---|---|---|---|---|
| 6,079,333 | A | 6/2000 | Manning et al. | |
| 6,644,202 | B1 | 11/2003 | Duniam et al. | |
| 6,941,870 | B2 | 9/2005 | McClure et al. | |
| 6,945,174 | B2 | 9/2005 | Aebi et al. | |
| 2008/0041260 | A1 * | 2/2008 | Koekemoer et al. | 102/217 |

FOREIGN PATENT DOCUMENTS

| | | |
|---|---|---|
| EP | 897098 | 2/1999 |
| EP | 897098 A2 * | 2/1999 |

* cited by examiner

*Primary Examiner*—James S Bergin
(74) *Attorney, Agent, or Firm*—Birch, Stewart, Kolasch & Birch, LLP

(57) ABSTRACT

A method for controlling the initiation of an electronic detonator when located in surrounding ground, the method comprising the steps of: measuring the actual spatial position of the said detonator in relation to one or more adjacent detonators; and calculating the time of initiation of the said detonator based upon its actual spatial position.

15 Claims, 1 Drawing Sheet

METHOD FOR CONTROLLING INITIATION OF A DETONATOR

This application is a Divisional of application Ser. No. 10/984,838 filed on Nov. 10, 2004, now abandoned and for which priority is claimed under 35 U.S.C. 120; and this application claims priority of Application No. 2003906228 filed in Australia on Nov. 12, 2003 under 35 U.S.C. 119; the entire contents of all are hereby incorporated by reference.

FIELD OF THE INVENTION

The present invention relates to the control of explosive detonators. In particular the invention relates to controlling the initiation of an electronic detonator for use in a mining process, and will primarily be described with reference to this context.

BACKGROUND ART

In mining processes an explosive blast is conducted to fracture an orebody to enable recovery of the broken rock to obtain its associated minerals. Explosive material and a detonator for initiating the explosion are placed into a series of pre-drilled narrow elongate holes (blast holes) in the orebody, the area is cleared of people and equipment, and an explosion is set off.

The optimisation of an explosive blast involves crying to obtain certain physical results from the explosion at minimum cost of explosive, which is a significant expense in many mining operations. The specific positioning of sufficient explosive to achieve a successful blast is a complex task. This task is complicated by a need to: avoid over-fragmentation of the rock; heave (or move) as much ore as possible into an accessible position; avoid over-vibration of the ground, around the area being mined; and to protect the working face (high wall of the orebody) and nearby floor of the area from collapse.

In general the desired physical outcomes of an explosive blast are determined by the initiation time between adjacent blast holes, and by matching the initiation time to the response time of the particular rock. The rock response time is related to the speed which cracks are generated around a blast hole by the stress/strain waves created by initiation of an explosion therein. Very hard rock usually has a fast response time (typically 1.5 milliseconds/metre of rock away from the hole), whereas very soft rock usually has a very slow response time (soft sandstone could be 6 milliseconds/metre of rock away from the hole). Blasting at above or below the actual response time can result in a less than optimal physical rock breakage performance.

Pyrotechnic detonators are typically used to initiate an explosion and can have a scatter (or error) of approximately 5% of the initiation time. More recently electronic detonators have been developed and have a scatter of approximately 0.1% so enable a much more optimal performance. Electronic detonators have a programmable microchip which replaces the traditional pyrotechnic delay element. As well as total timing accuracy, electronic detonators can be timed to initiate at intervals of typically anywhere from 0 to 20,000 ms in 1 ms steps. Such flexibility has provided blast design engineers with the ability to create complex blast timing designs.

In order to optimise the physical results of an explosive blast, blasting engineers usually create blast timing designs based on an assumed position of drill holes and a desired blast outcome. This design is typically done prior to drilling of any blast holes, and, out of necessity, assumes certain characteristics of the rock. Detonators are then programmed to go off at a fixed time and in a set sequence. However during drilling of blast, holes, complications can arise and a hole may not be able to be drilled in a pre-determined location because of varying ground conditions. Thus the pre-determined or designed blast hole pattern and the actual blast hole pattern may be very different. Production constraints mean that operators are under pressure to load, set and fire a blast as quickly as possible. Changes from the original blast design may cause major changes to the timing design, which can be very difficult for operators to implement at the time of blasting. The operators sometimes need to make new timing estimates (milliseconds/metre of rock away from the hole), and replace a pre-timed detonator, but an incorrect new estimate by an operator can result in poor physical rock breakage performance. The alternative method is for an accurate off-site redesign of the timing plan by the blast, engineer, however modifications to the blast once the detonators have been programmed may require several hours for redesigning and reprogramming, which is typically not available in a production situation.

SUMMARY OF THE INVENTION

In a first aspect, the present invention provides a method for controlling the initiation of an electronic detonator when located in surrounding ground, the method comprising the steps of:

- measuring the actual spatial position of the said detonator in relation to one or more adjacent detonators; and
- calculating the time of initiation of the said detonator based upon its actual spatial position.

By knowing the spatial position of the detonators in the actual blast hole pattern, and using this property to vary or manipulate the time for the detonator to indicate, rather than pre-programming the initiation time, the timing design of an explosion can be calculated by the blast operator immediately prior to the blast.

Preferably the actual spatial position of the or each electronic detonator is measured in relation to a coordinate reference point.

Preferably the spatial position is measured using an electronic positioning system. More preferably the electronic positioning system is one of an inertial positioning system or a global positioning system.

Preferably the step of calculating is carried out by a computing device capable of receiving an input such as a calculator, laptop computer, palm or the like.

In a second aspect the present invention provides a method for controlling the initiation of an electronic detonator when located in surrounding ground, the method comprising the steps of:

- locating the said detonator and one or more adjacent detonators in the ground using a pre-determined planned positional relationship;
- measuring the deviation between an actual located position and the pre-determined planned position of the said detonator in the ground; and
- calculating the time of initiation of the said detonator based upon the deviation.

By knowing the deviation in the position of the detonators in the actual blast hole pattern from the pre-determined planned blast hole pattern, and using this property to manipulate the time for the detonator to initiate, the timing design of an explosion can be readily modified by a blast operator immediately prior to a blast.

Preferably the determination of both the pre-determined planned positional relationship and the actual located position of the electronic detonator is made in relation to a coordinate reference point.

Preferably the deviation is measured with respect to the coordinate reference point.

Preferably the pre-determined planned positional relationship and the actual located position of the electronic detonator (s) is/are measured using an electronic positioning system.

Preferably the electronic positioning system is one of an inertial positioning system or a global positioning system.

Preferably the step of calculating is carried out by a computing device capable of receiving an input such as a calculator, laptop computer, palm or the like.

Preferably the said detonator and the adjacent detonators are arranged substantially in one or more rows, the latter arrangement forming a grid. Most preferably the row or rows forming a grid are substantially parallel to a working or excavation face of a mine.

In a third aspect the present invention provides a system for controlling the initiation of an electronic detonator when located in surrounding ground, the system comprising:

measuring means, for measuring the actual spatial position of the said detonator in relation to one or more adjacent detonators; and calculating means for calculating the time of initiation of the said detonator depending upon its actual spatial position.

Preferably the measuring means is arranged to measure the actual spatial position of the or each electronic detonator in relation to a coordinate reference point.

Preferably the measuring means is arranged to work in conjunction with an electronic positioning system.

Preferably the calculating means is a computing device capable of receiving an input such as a calculator, laptop computer, palm or the like.

In a fourth aspect the present invention provides a system for controlling the initiation of an electronic detonator when located in surrounding, ground with one or more adjacent detonators, the system comprising:

measuring means for measuring the deviation distance between an actual located position of the said detonator and a pre-determined planned position of the detonator in the ground; and calculating means for calculating the time of initiation of the said detonator based upon the deviation.

Preferably the measuring means is arranged to measure both the pre-determined planned position and the actual located position of the electronic detonator in relation to a coordinate reference point.

Preferably the measuring means is arranged to work in conjunction with an electronic positioning system.

Preferably the calculating means is a computing device capable of receiving an input such as a calculator, laptop computer, palm or the like.

In a fifth aspect the present invention provides a computer program arranged to instruct a computing system to operate in accordance with the method of the first and second aspects.

In a sixth aspect the present invention provides a computer program arranged to instruct a computing system to operate as a system in accordance with the third and fourth aspects.

In a seventh aspect the present invention provides a computer readable medium carrying a computer program according to either the fifth or sixth aspects.

BRIEF DESCRIPTION OF THE DRAWING

Notwithstanding any other forms which may fail within the scope of the present invention, preferred forms of the invention will now be described, by way of example only, with reference to the accompanying drawing in which.

MODES FOR CARRYING OUT THE INVENTION

Figure 1:
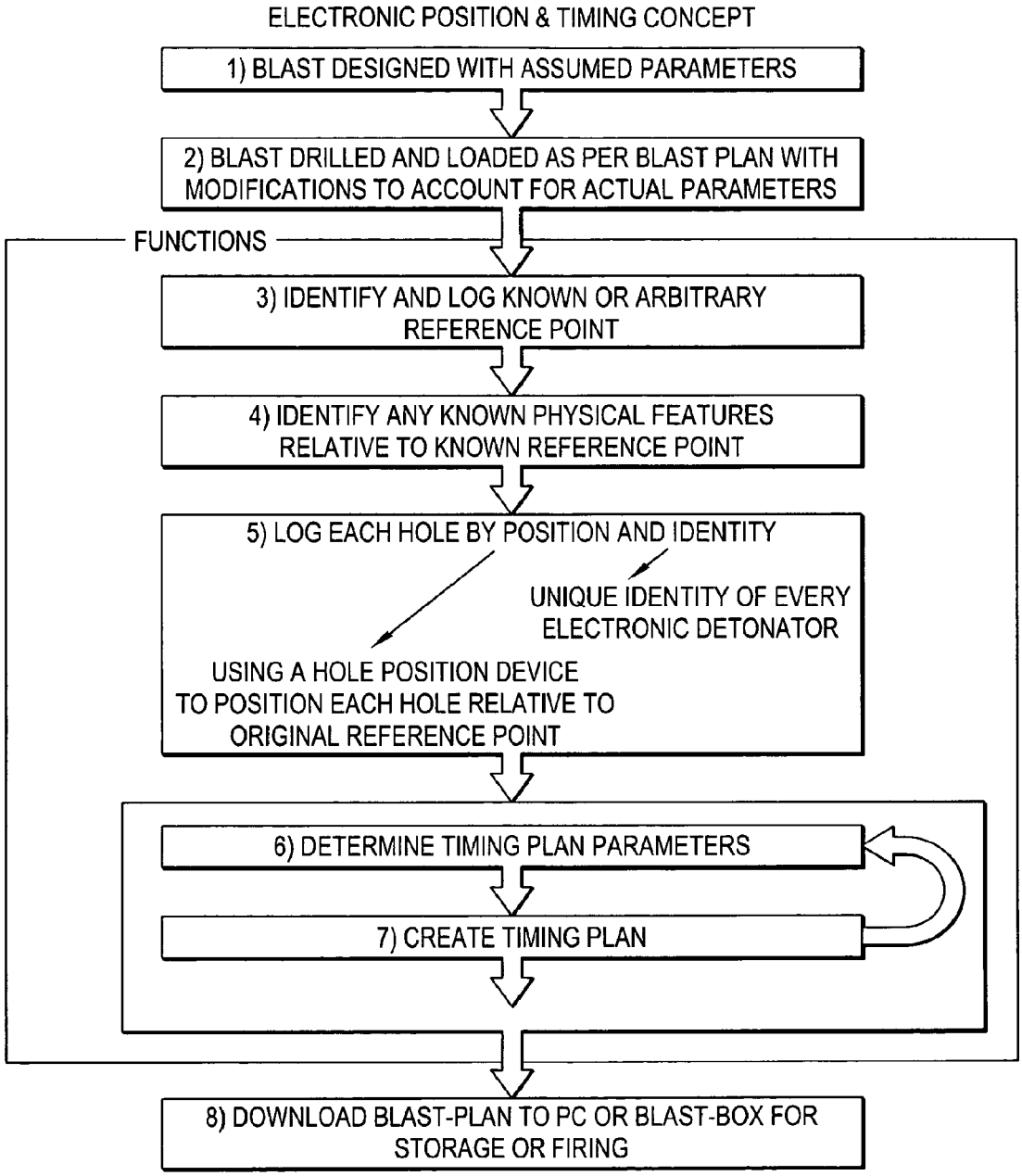
FIG. 1 shows a block flow diagram of one method for controlling the initiation of an electronic detonator in accordance with the invention.

To locate explosives and detonators in surrounding ground, for example in a bench at the working face of an open cut mine, typically a blast plan is made by a blast design engineer using assumed parameters of orebody hardness, distance between drilled blast holes for insertion of explosive, depth of hole and other input data. A drilling crew subsequently mark out the blast pattern and drill the blast holes as per the design, but the position of those holes may need to be adjusted to take into account on-site variations such as unexpected orebody hardness, breakage of the drill or crumbling or collapse of the hole requiring a new hole to be drilled. Typically the drilled blast holes for loading of explosive and a detonator are arranged substantially in a row or rows within a grid which are generally parallel to a working or excavation face of a mine, and the mine workings thus advance in a direction orthogonal to the row(s).

Example

An example according to the present invention will now be described.

Referring to FIG. 1, in one form of the method of the present invention, there is no planned blast pattern provided and the time of initiation of an electronic detonator was controlled by a blast operator once the placement of the explosive and detonator in surrounding ground has occurred.

The blast operator measured, the actual spatial position of the detonator(s) in relation to one or more adjacent detonators by first identifying and logging a known coordinate reference point, which can be one of a survey position, another blast hole or a physical feature such as the corner of the blast pattern area. Then the actual drilled blast hole spatial position was identified relative to that reference point. Each hole was also identified by a unique identity code or name, and its position was entered or logged into a recordal system. The order of identification of the blast holes in a blast pattern was irrelevant.

The spatial position of the blast holes was measured using a measuring means in the form of an electronic positioning system, usually an inertial positioning device (IPD) but a global positioning system (GPS) could also be used. The spatial position of each of the detonators was determined using a hand-held IPD (or GPS) unit which recorded a detonator identity and its location when; the IPD (or GPS) unit was placed in communication with the detonator (by physical contact, infrared reader, or electronic identification tag) when the detonator was positioned in the surrounding ground. The data from the hand-held unit was then transferred to a computer system for subsequent analysis, calculation of time of detonator initiation and archival.

In another variation, the detonators included an electronic positioning unit which was a transponder in communication with a local positioning system or an IPD or GPS which was itself in communication with the computer system.

The electronic positioning system alternatively included a laser theodolite tool (or other laser tape measures or electronic tape measures) which was used to manually survey the position of the blast holes for entry (manually or electronically) into a computer or other recording device. Any means of measuring the spatial position of the detonators when in position is within the scope of the invention.

A computer program was then used to calculate the time of initiation of any detonator based upon its logged actual spatial position in the blast pattern. Knowledge of the spatial position of the detonators in the actual blast hole pattern was used to manipulate the time for the detonator to initiate, rather than pre-programming the initiation time of any given detonator. Whereas the known methodology involved reading the unique identity of a detonator and assigning an initiation time to its assumed position or order of identification (or coding a unique identity and initiation time onto a microchip in the electronic detonator), prior to the actual blast hole pattern being developed, in the present method the timing design of the blast can be calculated (and substantially changed) by the blast operator immediately prior to the blast. In one instance the initiation time was assigned and coded, either by laser scanner or by actively connecting with and interrogating the chip.

The step of calculating the initiation time of the detonator was carried out by a calculating means in the form of a computing device capable of receiving inputs including actual position coordinate data. Devices employed included one of a calculator, laptop computer, palm or similar portable digital assistant, enabled mobile telephone or other computing device. The coordinate data, was entered directly from the electronic positioning system or by manual entry. A computer program was used to instruct the computing device. The computer program was provided on a computer readable medium such as a CD-Rom, computer disc or the like.

In another variation where there was a pre-determined planned blast pattern provided by a blast design engineer, for each particular blast hole in the ground the blast operator located a detonator along with explosives in the hole and then measured the deviation between the actual located position and the pre-determined planned position of the detonator in the ground. The operator then calculated the time of initiation of the detonator(s) based upon the deviation.

As previously described, the blast operator measured both the pre-determined planned positional relationship and the actual spatial position of the detonator(s) by first identifying and logging a known coordinate reference point, and then the actual drilled blast hole spatial position was identified relative to that reference point. As previously described, each hole was also identified by a unique identity code or name, and its position was entered, or logged into a recordal system. The order of identification of the blast holes in a blast pattern was irrelevant. The pre-determined planned position of the blast holes used by the blast design engineer was usually developed by the use of proprietary computer software.

The deviation was measured with respect to the coordinate reference point, so that vector details (x, y and z coordinate positional details) were recorded. This meant that both the distance and the direction that the actual spatial position of the detonator was spaced from the pre-determined planned positional relationship of that detonator was measured.

The spatial position of the blast holes was measured using a measuring means in the form of an electronic positioning system, embodiments of which are described above.

A computer program was then used to calculate the time of initiation of any detonator based upon its deviation from the pre-determined planned position of that detonator in the blast pattern. This deviation was used to manipulate the time for the detonator to initiate, rather than pre-programming the initiation time of the detonator. The planned timing design of an explosion was readily modified by a blast operator immediately prior to a blast by knowing the deviation in the position of the detonators in the actual blast hole pattern from the pre-determined planned blast hole pattern, and using this property to manipulate the time for the detonator to initiate.

The step of calculating the initiation time of the detonator was carried out by calculating means in the form of a computing device capable of receiving an input including the deviation coordinate data, several possible embodiments of which have been previously described.

Different timing plan parameters were used to calculate different blast outcomes. Different blast hole positions were able to be added or deleted to the timing plan to allow easy modification of a blast or even redirection, or reorientation of an entire blast. The timing of initiation of each detonator was a variable and was able to be changed at any time prior to the blast, sometimes even only minutes beforehand.

The practical outcome of these method and systems was that the physical results of an explosive blast were optimised by reducing the variability in explosion timing often introduced by blast operators making last minute changes to an original blast design sequence. Initial experiments revealed that an increase in excavator production of around 10-25% could be achieved, both because of improved physical rock breakage performance (more even rock fragmentation, achievement of better heave) as well as other operational time savings including the avoidance of blast redesign or reprogramming delays, faster ore clearing, operations, and more stabilised working faces, reducing likely incidences of collapse and further production delays. At a gold mine, a 10% increase in ore throughput can be worth extra revenue of many thousands of dollars per hour.

It is to be understood that, if any prior art information is referred to herein, such reference does not constitute an admission that the information forms a part of the common general knowledge in the art, in Australia, or any ether country.

Whilst the invention has been described with reference to preferred embodiments it should be appreciated that the invention can be embodied in many other forms.

What is claimed is:

1. A method for controlling the initiation of plurality of electronic detonators when located in surrounding ground, the method comprising the steps of:

locating said detonators and one or more adjacent detonators in the ground using a pre-determined planned positional relationship, this pre-determined planned positional relationship having an associated planned timing design for an initiator of each of the plurality of detonators;

measuring the deviation between an actual located position and the pre-determined planned position of each of said detonators in the ground; and calculating the time of initiation of each of said detonators based upon the deviation and modifying the planned timing design accordingly.

2. A method as claimed in claim 1 wherein determination of both the pre-determined planned positional relationship and the actual located position of each of the electronic detonators is made in relation to a coordinate reference point.

3. A method as claimed in claim 2 wherein the deviation is measured with respect to the coordinate reference point.

4. A method as claimed in claim 1 wherein the pre-determined planned positional relationship and the actual located position of each of the electronic detonators is measured using an electronic positioning system.

5. A method as claimed in claim 1 wherein the electronic positioning system is one of an inertial positioning device or a global positioning system.

6. A method as claimed in claim 1 wherein the step of calculating is carried out by a computing device capable of receiving an input.

7. A method as claimed in claim 1 wherein said computing device is a calculator, a laptop computer, or a palm device.

8. A method as claimed in claim 1 wherein the said detonators and the adjacent detonators are arranged substantially in one or more rows, the latter arrangement forming a grid.

9. A method as claimed in claim 8 wherein the row or rows forming a grid are substantially parallel to a working or excavation face of a mine.

10. A system for controlling the initiation of a plurality of electronic detonators when located in surrounding ground with one or more adjacent detonators, the system comprising:

measuring means for measuring the deviation distance between an actual located position of each of said detonators and a pre-determined planned position of each of the detonators in the ground, this pre-determined planned positional relationship having an associated planned timing design for an initiator of each of the plurality of detonators; and calculating means for calculating a modified time of initiation of each of the said detonators based upon the deviation and the planned timing design.

11. A system as claimed in claim 10 wherein the measuring means is arranged to measure both the pre-determined planned position and the actual located position of each of the electronic detonators in relation to a coordinate reference point.

12. A system as claimed in claim 11 wherein the measuring means is arranged to work in conjunction with an electronic position system.

13. A system as claimed in claim 10 wherein the measuring means is arranged to work in conjunction with an electronic positioning system.

14. A system as claimed in claim 10 wherein the calculating means is a computing device capable of receiving an input.

15. A system as claimed in claim 14 wherein said computing device is a calculator, a laptop computer, or a palm device.

* * * * *

UNITED STATES PATENT AND TRADEMARK OFFICE

CERTIFICATE OF CORRECTION

PATENT NO. : 7,578,237 B2
APPLICATION NO. : 11/869703
DATED : August 25, 2009
INVENTOR(S) : Peter Johnston It is certified that error appears in the above-identified patent and that said Letters Patent is hereby corrected as shown below:

ON THE COVER PAGE:

In section (73) Assignee, please change the Assignee information from "Redbull Powder Co. Limited, Auckland (NZ)" to --Orica Explosives Technology Pty Ltd., Melbourne, Victoria (AU)--.

Signed and Sealed this

Sixteenth Day of March, 2010

David J. Kappos

David J. Kappos
*Director of the United States Patent and Trademark Office*